US005787607A

United States Patent [19]

Schürch

[11] Patent Number: 5,787,607

[45] Date of Patent: Aug. 4, 1998

[54] SHOE-COVER

[76] Inventor: Primo Schürch, Sonnhaldenstrasse 3, CH-6052, Hergiswil, Switzerland

[21] Appl. No.: 526,951

[22] Filed: Sep. 12, 1995

[30] Foreign Application Priority Data

Mar. 16, 1995 [DE] Germany ..... 195 09 084.5

[51] Int. Cl.[6] ..... A43B 3/16

[52] U.S. Cl. ..... 36/7.1 R; 36/59 R

[58] Field of Search ..... 36/7.1 R, 59 R, 36/7.4, 7.6

[56] References Cited

U.S. PATENT DOCUMENTS

| | | | |
|---|---|---|---|
| 2,924,029 | 2/1960 | Rosen | 36/7.1 R |
| 4,562,834 | 1/1986 | Bates | 36/7.1 R X |
| 4,665,633 | 5/1987 | Edgerton | 36/7.1 R X |
| 4,788,780 | 12/1988 | Boggs | 36/7.1 R |
| 4,825,564 | 5/1989 | Sorce | 36/7.1 R X |
| 4,918,839 | 4/1990 | Brandon | 36/7.1 R |
| 5,067,260 | 11/1991 | Jenkins, Jr. | 36/7.1 R |

FOREIGN PATENT DOCUMENTS

| | | |
|---|---|---|
| 2619998 | 3/1989 | France . |
| 13240 | 9/1916 | United Kingdom . |
| 2163638 | 3/1986 | United Kingdom . |

*Primary Examiner*—Ted Kavanaugh

*Attorney, Agent, or Firm*—Tarolli, Sundheim, Covell, Tummino & Szabo

[57] ABSTRACT

A shoe cover for being worn over the shoes consists of a cover foil adapted to protect the shoe and at least a part of the calf of a person and a reinforcing foil adapted to reinforce at least the sole portion of the cover foil. The cover foil is made of a first soft or plasticized polymer, and the reinforcing foil is made of a second soft or plasticized polymer. Besides the sole portion, the cover foil consists of a shaft portion. The sole portion of the cover foil is reinforced by the reinforcing foil by welding them together by means of a plurality of punctual welding points. Those welding points form a plurality of punctual recesses in the reinforcing foil, which recesses cause a sucker effect, such that a high adhesion between the shoe cover and the ground results. At the shaft portion, the cover foil is provided with a strap or a tape which allows to tighten the shoe cover at the foot or calf of a person. Such a shoe cover is lightweight, may be used several times and, due to the fact that it may be folded, needs not much space for storing.

12 Claims, 1 Drawing Sheet

SHOE-COVER

BACKGROUND OF THE INVENTION

The present invention relates generally to shoe covers which are worn over the regular shoes.

Such shoe covers are supposed to protect the shoes against dirt and wetness.

PRIOR ART

The prior art shows shoe covers which are made of a thin plastic foil. Those known shoe covers are provided at the upper end with a strap or an elastic tape which helps to fix the shoe cover on the foot or calf of a person. Those shoe covers primarily protect the shoes against wetness and have the disadvantage that they have a low toughness. Therefore, such shoe covers are normally disposables and are used only once or two times, especially due to the fact that they are mostly damaged after having been worn once.

Another disadvantage of such shoe covers is that they do not ensure a safe standing position. Further, under an ecological point of view, such shoe covers cannot be recommended.

Additionally to those shoe covers, boots are also known which are worn like shoes and also protect against dirt and wetness. Such boots are provided with a solid sole with a profile and a dimensionally stable shaft. Those boots have the disadvantage to need a lot of space for storing; because of the stable sole and the dimensionally stable shaft they cannot be folded. Another disadvantage of those known boots is that the regular shoes have to be taken off before the boots may be put on. Further, those boots are relatively high in weight.

OBJECTS OF THE INVENTION

It is an object of the invention to provide a shoe cover which may be used several times. It is a further object of the invention to provide a shoe cover which is light in weight. It is a still further object of the invention to provide a shoe cover which is water resistant. It is a still further object of the invention to provide a shoe cover which has good anti slip properties. It is a still further object of the invention to provide a shoe cover which has a high working life. It is a still further object of the invention to provide a shoe cover which may be easily and securely tightened at the foot or calf. It is a still further object of the invention to provide a shoe cover which may be used for different shoe sizes, and it is a still further object of the invention to provide a shoe cover which does not need much room for storing.

SUMMARY OF THE INVENTION

In order to meet all these and other objects and to solve the problems mentioned herein before, and further to create a wear-resistant, lightweight, foldable shoe cover with good anti slip properties, the shoe cover comprises a cover means adapted to cover a shoe and at least a part of the calf of a person. The shoe cover further comprises a reinforcing means adapted to reinforce at least the sole portion of the cover means. For fixing the cover means to the calf of a person, fixing means are attached to the cover means.

The cover means is made of a first soft or plasticized polymer and the reinforcing means is made of a second soft or plasticized, wear-resistant polymer. The reinforcing means is welded to the outer side of the cover means such that the reinforcing means reinforces the outer side of at least the sole portion of the cover means.

The cover means and the reinforcing means are made of such a soft or plasticized polymer that the entire shoe cover may be folded for storing.

In a preferred embodiment of the shoe cover, the cover means and the reinforcing means are welded together by a plurality of punctual welding points which form a plurality of punctual recesses in the reinforcing means. Those recesses cause an effect like a sucker on the ground such that a high adhesion between the shoe cover and the ground results. Therefore, such a shoe cover ensures a safe foothold on the ground even under difficult conditions like wet floors, ice, snow or the like.

BRIEF DESCRIPTION OF THE DRAWINGS

In the following, a preferred embodiment of the invention is further described, with reference to the attached drawings, in which.

DETAILED DESCRIPTION OF A PREFERRED EMBODIMENT

Figures 1, 2:
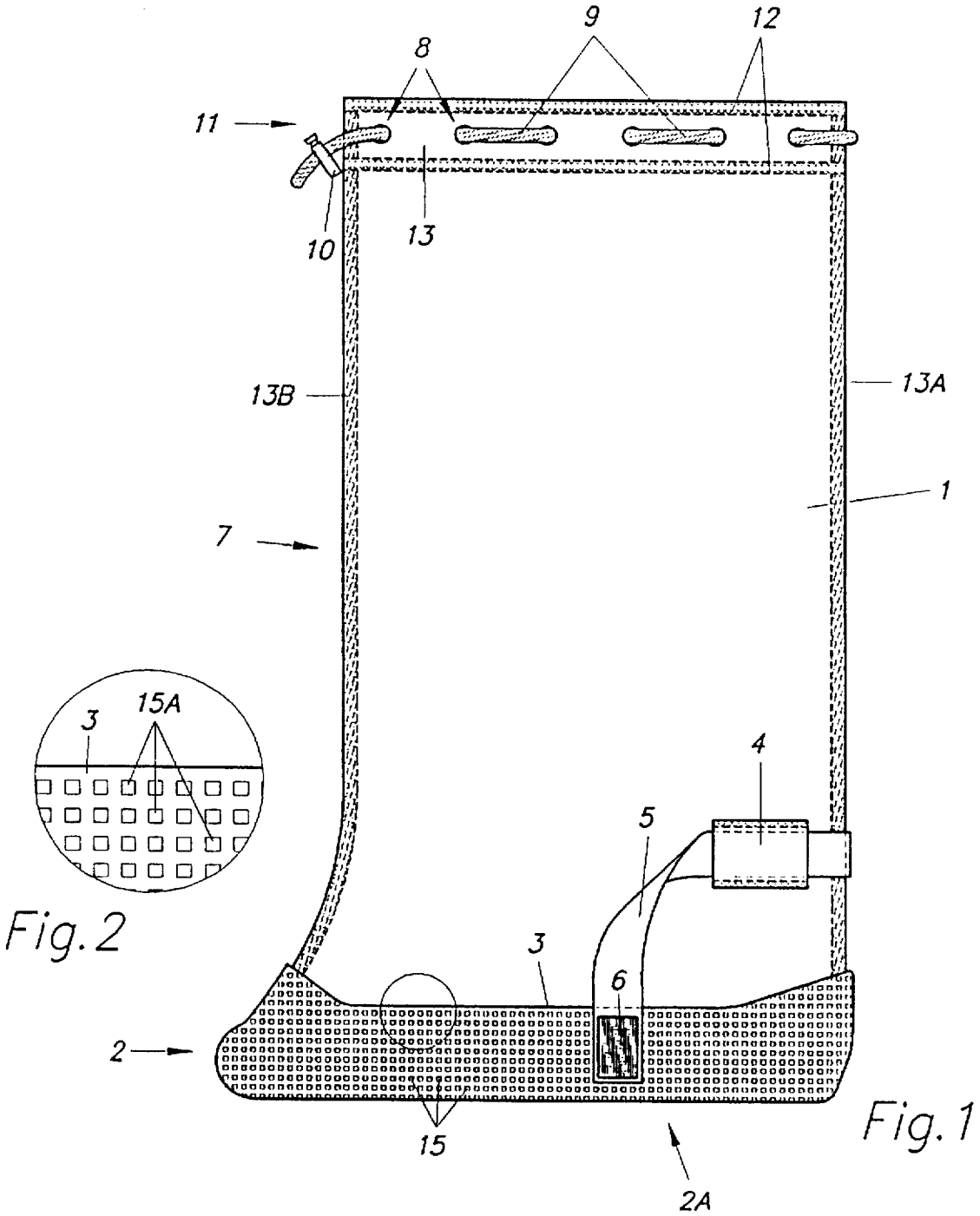
FIG. 1 shows a side view of a schematically shown shoe cover.
FIG. 2 shows an enlarged detail of FIG. 1.

FIG. 1 shows a side view of a schematically shown, boot like shoe cover. This boot like shoe cover is designed to be worn over the regular shoes. The shoe cover comprises a cover member 1 and a reinforcing member 3. The cover member 1 has a sole portion 2 and a shaft portion 7 and is made of a first soft or plasticized polymer on the basis of PVC or polyethylene. The reinforcing member 3 is made of a second soft or plasticized polymer also on the basis PVC or polyethylene. However, the first and second polymers, respectively, are treated in a different way during manufacture. The first polymer may be treated such that it is softer and thereby easily clings to the calf of the person wearing the shoe covers. The second polymer is treated to be a bit harder, however still easily foldable, very wear resistant and, moreover, can be a little thicker than the first polymer. Since any person skilled in the art of manufacturing polymers is well aware of the techniques of treating the basic material, there is no need to give further explanations here.

On the outer side of the sole portion 2, the cover member 1 is reinforced by means of the reinforcing member 3. This reinforcing member 3 is preferably made of an elastic polymer foil which is not susceptible against low temperatures, which is wear resistant and UV stable. The reinforcing member 3 is welded together with the cover member 1 in a specific manner as will be described herein after in detail. The color of the reinforcing member 3 is preferably different from the color of the cover member 1. While the reinforcing member 3 is mostly dark, the cover member 1 is mostly of a glowing color which helps to recognize people wearing such shoe covers and therefore improves the security.

The cover member 1 is provided with two fixing member 5, 9. One fixing member 9 is located at the upper end of the shaft 7 and the other fixing member 5 is located just above the sole portion 2. Both fixing member 5, 9 are supposed for tightening the shoe cover on the calf of a person. The fixing member 5, which is located just above the sole portion 2, comprises two loops 4, but only one of them is shown in this drawing. Those loops 4 are made of the same material as the cover member 1 and are welded together with the cover member 1. A fixing tape 5 is pulled through the loops 4 and provided at the ends with a velcro strip fastener 6. With this fixing tape 5, the shoe cover may be drawn together and fixed over the shoes at the foot and or the calf of a person.

At the upper end 11 of the shaft 7, the cover member 1 is reinforced by a border 13, which is made by folding the cover member 1 at its upper end 11 towards the inner side of the shaft 7. This border 13 is fixed in its position of the cover member 1 by two welding seams 12. In this upper portion 11 of the cover member, several holes are let into the border 13 respectively into the cover member 1. Through those holes a strap 9 is drawn. Both ends of the strap 9 are provided with a clamping mechanism 10, which allows to draw the shaft 7 together, and, by fixing the strap with the clamping mechanism 10, tightening the shoe cover on the calf of a person. Instead of a strap 9, an elastic tape may be provided.

The reinforcing member 3, joined together with the cover member 1, overlaps the cover member 1 on all sides over the sole 2 portion of the shoe cover. This reinforcing member 3 is fixed to the cover member 1 by a plurality of punctual welding points 15. Because of those welding points 15, a plurality of punctual recesses 15A (FIG. 2) are created in the reinforcing member 3. Those recesses 15A, housed in the relatively soft polymer foil 3, are scattered over the hole surface of the reinforcing member 3, and have an effect like that of a sucker. Therefore, the recesses 15A help to increase the adhesion between the ground and the sole 2A of the shoe cover such that the shoe cover has good anti-slip characteristics also on difficult floors like ice, snow, wet floors and the like. The reinforcing member 3 and the cover member 1 are joined together preferably by high frequency welding.

The inner surface of the cover member 1 is provided with a cloth or a hosiery, made of a textile material, i.e. polyester or the like, which cloth or hosiery reinforces the cover member 1 and helps to put on and take off the shoe cover by decreasing the coefficient of friction between the inner surface of the shoe cover and the shoes.

The cover member 1 consists of two halves which are welded together along the shaft 7. Those welding seams are designated by reference numerals 13A and 13B. By welding together the reinforcing member 3 and the cover member 1 by means of a plurality of welding points 15, which are scattered over the entire reinforcing member 3, the latter helps to seal the sole portion 2 of the cover member 1 and therefore guarantees a well sealed, waterproof shoe cover. Sealing the sole portion 2 of the cover member 1 by known welding, without a reinforcing member 3 welded together with the cover member 1 by a plurality of welding points, would be difficult and needs a lot of know how.

The advantage of a shoe cover made in the described manner is that it can be used as long as one likes, that it can be folded to minimize the space needed for storing and that it guarantees good anti-slip characteristics also on difficult grounds. If the shoe cover is folded, it may be stored i.e. in the glove compartment of a car. Such shoe covers were tested during more than one hundred hours with the result that the abrasion is remarkably low.

It is intended to provide three different shoe cover sizes such that it suits for the most used shoe sizes. Further, one and the same shoe cover is adapted to be worn either at the left foot or calf or at the right foot or calf.

While the invention has been described and shown with particular reference to a preferred embodiment, it will be apparent that variations and modifications are possible within the spirit of the invention. For example, shoe covers with no or a short shaft are conceivable. There is also no limit relating to the materials and/or the fixing member.

What is claimed is:

1. Shoe cover comprising:

a cover means adapted to cover a shoe and at least a part of a calf of a person, said cover means having an inner surface, an outer surface, and a sole portion;

a reinforcing means reinforcing at least said sole portion of said cover means;

a fixing means attached to said cover means and adapted to fix said cover means to the calf of a person wearing said shoe cover;

said cover means being made of a first plasticized polymer;

said reinforcing means being made of a second plasticized, wear resistant polymer;

said reinforcing means being welded to the outer surface of said cover means by a plurality of welding points such that said reinforcing means reinforces said cover means on the outer surface of at least said sole portion;

said welding points forming a plurality of recesses in said reinforcing means, wherein said recesses create a suction effect such that a high adhesion between said shoe cover and the ground results; and said cover means and said reinforcing means being foldable for storing, said plurality of welding points joining together said cover means and said reinforcing means being scattered over the entire surface of said reinforcing means.

2. Shoe cover according to claim 1 wherein said reinforcing means overlaps said sole portion of said cover means on all sides.

3. Shoe cover according to claim 1 wherein said cover means further comprises a shaft portion extending away from said sole portion to provide said cover means with a boot-like shape, said fixing means being attached to an upper end of said shaft portion.

4. Shoe cover according to claim 3 wherein the upper end of said shaft portion of said cover means is folded and welded to the inner surface of said shaft such that a border is created, the upper end of said shaft of said cover means being provided with a plurality of holes through which a strap member is extendable through, said strap member serving for fixing said upper end of said shoe cover on the calf of a person.

5. Shoe cover according to claim 3 wherein the upper end of said shaft of said cover means is provided with a border, said border being made by folding the upper end of said shaft to the inner surface of said cover means and welding said border together with said shaft, and wherein the upper end of said shaft of said cover means is provided with a plurality of holes through which an elastic strip is extendable, such that the upper end of said shoe cover may be fixed on the calf of a person.

6. Shoe cover according to claim 1 wherein said inner surface of said cover means is provided with a textile material, and wherein said cover means and said reinforcing means are made of PVC.

7. Shoe cover according to claim 1 wherein said cover means comprises two portions which are welded together, and wherein said reinforcing means is welded together with said cover means in such a manner that said cover means is additionally sealed.

8. Shoe cover according to claim 1 wherein said cover means is provided with two loops made of the same material as said cover means, said loops being positioned above said sole portion of said cover means, and wherein a tape member is provided which is pulled through said loops, said tape member being disposed at opposite ends with a fastener such that said shoe cover may be fixed above said sole portion on the calf of a person.

9. Shoe cover according to claim 1 wherein the color of said reinforcing means is different from the color of said cover means.

10. Shoe cover according to claim 1 wherein said shoe cover may be worn on the left foot and the right foot.

11. Shoe cover according to claim 1 wherein said welding of said reinforcing means to said cover means is a high frequency welding.

12. Shoe cover comprising:

a cover means adaptable to cover a shoe and at least a part of a calf of a person when worn by the person, said cover means having a sole portion for covering the shoe, a shaft portion for covering at least part of the calf, an inner surface, and an outer surface, said inner surface of the cover means facing toward the shoe and the calf of a person when the cover means is worn by the person;

a reinforcing means covering and reinforcing at least said sole portion of said cover means;

a fixing means attached to said cover means and adapted to fix said cover means to the calf of a person wearing said shoe cover;

said cover means being made of a first plasticized polymer;

said reinforcing means being made of a second plasticized, polymer, said second polymer being more wear resistance than said first polymer;

said reinforcing means being welded to the outer surface of said cover means by a plurality of welding points;

said welding points forming a plurality of spaced apart recesses in said reinforcing means extending over substantially all of said reinforcing means, said recesses creating a suction effect between said shoe cover and a surface such that a high adhesion between said shoe cover and the surface results when the person moves the shoe cover against the surface; and said cover means and said reinforcing means being foldable for storing.

* * * * *